US009417588B2

(12) United States Patent
Kato

(10) Patent No.: US 9,417,588 B2
(45) Date of Patent: Aug. 16, 2016

(54) IMAGE FORMING APPARATUS

(71) Applicant: KYOCERA Document Solutions Inc., Osaka-shi, Osaka (JP)

(72) Inventor: Yusuke Kato, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days.

(21) Appl. No.: 14/805,488

(22) Filed: Jul. 22, 2015

(65) Prior Publication Data

US 2016/0026135 A1 Jan. 28, 2016

(30) Foreign Application Priority Data

Jul. 25, 2014 (JP) ..... 2014-151401

(51) Int. Cl.

| | |
|---|---|
| ***G03G 15/00*** | (2006.01) |
| ***G03G 15/20*** | (2006.01) |
| ***B41J 11/00*** | (2006.01) |

(52) U.S. Cl.

CPC ..... *G03G 15/657* (2013.01); *B41J 11/0005* (2013.01); *G03G 15/205* (2013.01); *G03G 15/5029* (2013.01); *G03G 15/6576* (2013.01); *G03G 15/6582* (2013.01); *B65H 2301/51256* (2013.01); *G03G 2215/0067* (2013.01)

(58) Field of Classification Search

CPC ..... B65H 2301/512256; G03G 15/6576; G03G 2215/00662

See application file for complete search history.

(56) References Cited

U.S. PATENT DOCUMENTS

| | | | | |
|---|---|---|---|---|
| 5,095,342 A * | 3/1992 | Farrell | G03G 15/234 355/23 |
| 8,515,327 B2 * | 8/2013 | Hatazaki | G03G 15/6573 399/341 |
| 9,044,981 B2 * | 6/2015 | Imamiya | B41J 29/36 |

FOREIGN PATENT DOCUMENTS

| | | |
|---|---|---|
| JP | 2007212526 A | 8/2007 |
| JP | 2013242362 A | 12/2013 |

* cited by examiner

*Primary Examiner* — Justin Olamit

(57) ABSTRACT

An image forming apparatus has a developing unit, a fixing unit, a receiving unit, a paper setting unit, and a control unit. The fixing unit conveys paper on which a visible image is formed by the developing unit between a heating roller and a pressurizing roller to fix the visible image to the paper. The receiving unit receives a demand for smoothing-out of wrinkles of the paper. The paper setting unit sets paper to be subjected to smoothing-out of wrinkles. When the receiving unit receives the demand for smoothing-out of wrinkles, the control unit performs control so that the developing unit is not operated and the paper to be subjected to smoothing-out of wrinkles set in the paper setting unit is conveyed to the fixing unit.

4 Claims, 7 Drawing Sheets

IMAGE FORMING APPARATUS

INCORPORATION BY REFERENCE

The disclosure of Japanese Patent Application No. 2014-151401 filed on Jul. 25, 2014 including the specification, drawings and abstract is incorporated herein by reference in its entirety.

BACKGROUND

The disclosure relates to an image forming apparatus.

In an image forming apparatus typified by a digital multifunctional peripheral or the like, an image of a document is read by an image reading unit, and then an electrostatic latent image is formed on a photoconductor provided in an image forming unit based on the read image. Then, a developing agent, such as charged toner, is supplied onto the formed electrostatic latent image to form a visible image, the visible image is transferred and fixed to paper, and then the paper is discharged to the outside of the apparatus. Paper to which a visible image is to be transferred is fed at all times into the image forming apparatus from a paper feed cassette provided in the image forming apparatus.

Herein, a technique of reducing occurrence of folding when conveying paper in the image forming apparatus is known heretofore.

According to a typical fixing device, from the viewpoint of prevention of occurrence of wrinkles and folding when fixing an envelope and fixing stability to the envelope, a recording material is passed between nips formed by pressing a pressurizing member against a fixing member to fix the same by heating and pressurizing. The fixing device allows passage and fixation of an envelope and is configured so that the pressurization power of the pressurizing member to the fixing member can be varied, and the pressurization power during the passage of the envelope is set to 45 to 60% of the pressurization power during the passage of plain paper and the fixing temperature during the passage of the envelope is higher than the fixing temperature during the passage of plain paper.

From the viewpoint of suppressing occurrence of folded edge, paper jamming, and the like at a turning point of a conveying path and a reversing path, a typical image forming apparatus has a fixing means which performs fixing processing to each paper P to which a toner image is transferred, a conveying path R1 through which each paper from the fixing means passes, a pair of reversing rollers which switch back the paper P from the conveying path R1, a reversing path R2 which shares a section from the pair of reversing rollers to a second turning point P2 on the conveying path R1 with the conveying path R1 and through which the switched back paper P passes, and an angle controlling means which lets the following paper P which is to be switched back by the pair of reversing rollers enter at an angle less than 90° at the second turning point P2.

SUMMARY

An image forming apparatus according to one aspect of the disclosure has a developing unit, a fixing unit, a receiving unit, a paper setting unit, and a control unit. The developing unit forms a visible image on paper using a developing agent. The fixing unit includes a heating roller and a pressurizing roller abutting on the heating roller. The fixing unit conveys the paper on which the visible image is formed by the developing unit between the heating roller and the pressurizing roller to fix the visible image to the paper. The receiving unit receives a demand for smoothing-out of wrinkles of the paper. The paper setting unit sets paper to be subjected to smoothing-out of wrinkles. When the receiving unit receives the demand for smoothing-out of wrinkles, the control unit performs control so that the developing unit is not operated and the paper to be subjected to smoothing-out of wrinkles set in the paper setting unit is conveyed to the fixing unit.

DETAILED DESCRIPTION

Figure 1:
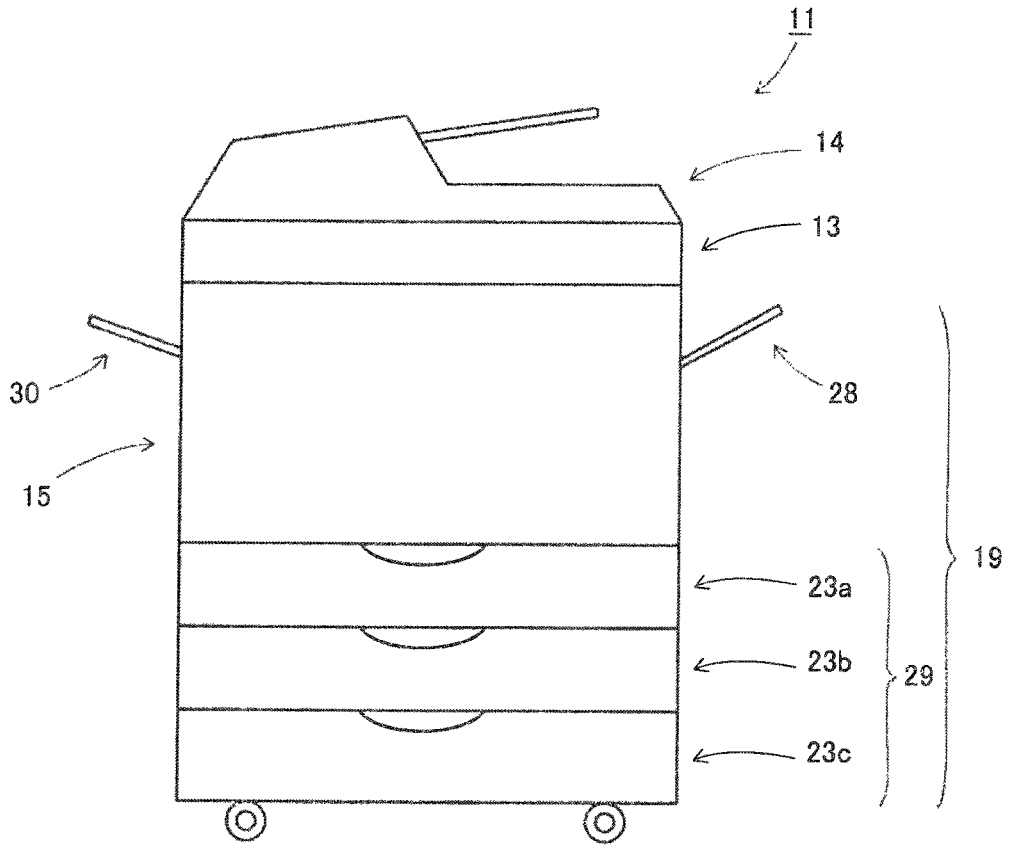
FIG. 1 is a schematic perspective view illustrating the appearance of a digital multifunctional peripheral when applying an image forming apparatus according to one embodiment of the disclosure to the digital multifunctional peripheral.
Figure 2:
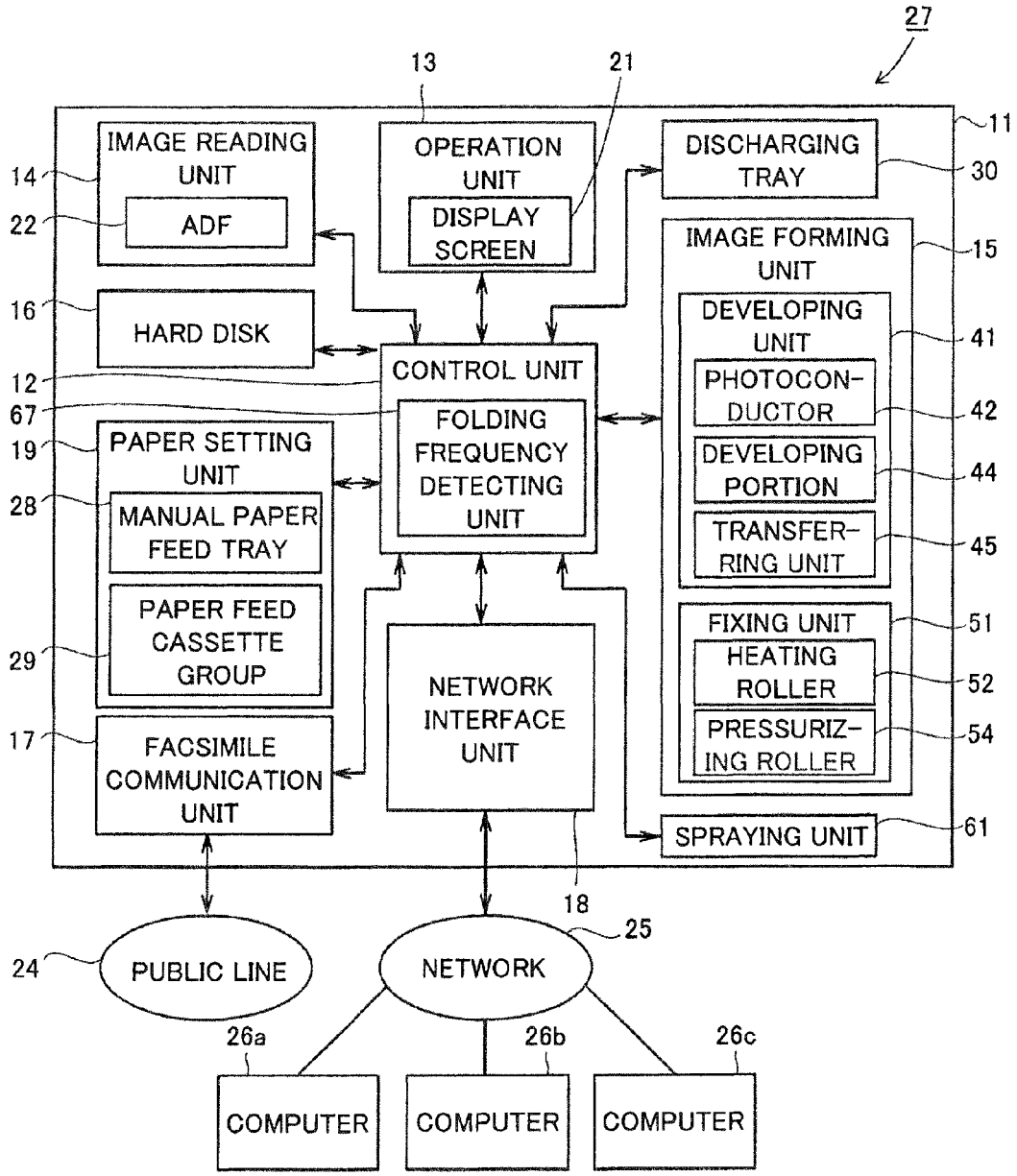
FIG. 2 is a block diagram illustrating the configuration of the digital multifunctional peripheral when applying the image forming apparatus according to one embodiment of the disclosure to the digital multifunctional peripheral.

Hereinafter, embodiments of the disclosure are described. First, the configuration of a digital multifunctional peripheral when applying an image forming apparatus according to one embodiment of the disclosure to the digital multifunctional peripheral is described. FIG. 1 is a schematic view illustrating the appearance of the digital multifunctional peripheral when applying the image forming apparatus according to one embodiment of the disclosure to the digital multifunctional peripheral. FIG. 2 is a block diagram illustrating the configuration of the digital multifunctional peripheral when applying the image forming apparatus according to one embodiment of the disclosure to the digital multifunctional peripheral.

Referring to FIG. 1 and FIG. 2, a digital multifunctional peripheral 11 has a control unit 12, an operation unit 13, an image reading unit 14, a paper setting unit 19, an image forming unit 15, a discharging tray 30, a hard disk 16, a facsimile communicating unit 17, and a network interface unit 18 for connection with a network 25. The control unit 12 controls the entire digital multifunctional peripheral 11. The operation unit 13 contains a display screen 21 which displays information transmitted from the digital multifunctional peripheral 11 and input contents of a user. The operation unit 13 inputs image formation conditions, such as the number of prints, gradation, and the like and turns ON or OFF the power supply. The image reading unit 14 contains an ADF (Auto Document Feeder) 22 which automatically conveys a set document to a reading unit. The image reading unit 14 reads an image of a document. The paper setting unit 19 contains a manual paper feed tray 28 which manually sets paper and a paper feed cassette group 29 capable of storing two or more sheets of paper different in size. The paper setting unit 19 sets a paper on which an image is formed and paper to be subjected to smoothing-out of wrinkles described later. The image forming unit 15 forms an image based on a read image or image data transmitted through the network 25. The discharging tray 30 discharges paper after forming an image on the paper by the image forming unit 15. The hard disk 16 stores transmitted image data, input image formation conditions, and the like. The facsimile communicating unit 17 is connected to a public line 24 and performs facsimile transmission and facsimile receiving. The digital multifunctional peripheral 11 has a DRAM (Dynamic Random Access Memory) which writes or reads image data and the like but the illustration and the description thereof are omitted. The arrows in FIG. 2 indicate the flow of control signals and data relating to control and an image. As illustrated in FIG. 1, in this embodiment, the paper feed cassette group 29 contains three paper feed cassettes 23*a*, 23*b*, and 23*c*.

The digital multifunctional peripheral 11 operates as a copying machine by forming an image in the image forming unit 15 using image data of a document read by the image reading unit 14. The digital multifunctional peripheral 11 operates as a printer by forming an image in the image forming unit 15, and then prints the image on paper using image data transmitted from computers 26*a*, 26*b*, and 26*c* connected to the network 25 through the network interface unit 18. The digital multifunctional peripheral 11 operates as a facsimile machine by forming an image in the image forming unit 15 through the DRAM using image data transmitted from the public line 24 through the facsimile communicating unit 17 and transmitting image data of a document read by the image reading unit 14 to the public line 24 through the facsimile communicating unit 17. More specifically, the digital multifunctional peripheral 11 has a plurality of functions relating to image processing, such as a copying function, a printer function, and a facsimile function. Furthermore, the digital multifunctional peripheral 11 has a function capable of setting each function in detail.

An image processing system 27 containing the digital multifunctional peripheral 11 has the digital multifunctional peripheral 11 and the plurality of computers 26*a*, 26*b*, and 26*c*. Specifically, the image processing system 27 has the digital multifunctional peripheral 11 of the configuration described above and the plurality of computers 26*a*, 26*b*, and 26*c* connected to the digital multifunctional peripheral 11 through the network 25. In this embodiment, the plurality of computers 26*a* to 26*c* includes three computers. Each of the computers 26*a* to 26*c* can request the digital multifunctional peripheral 11 to perform printing through the network 25. The digital multifunctional peripheral 11 and the computers 26*a* to 26*c* may be connected by wire using a LAN (Local Area Network) cable or the like or may be connected by radio. A configuration in which another digital multifunctional peripheral and a server may be connected into the network 25 may be acceptable.

Figure 3:
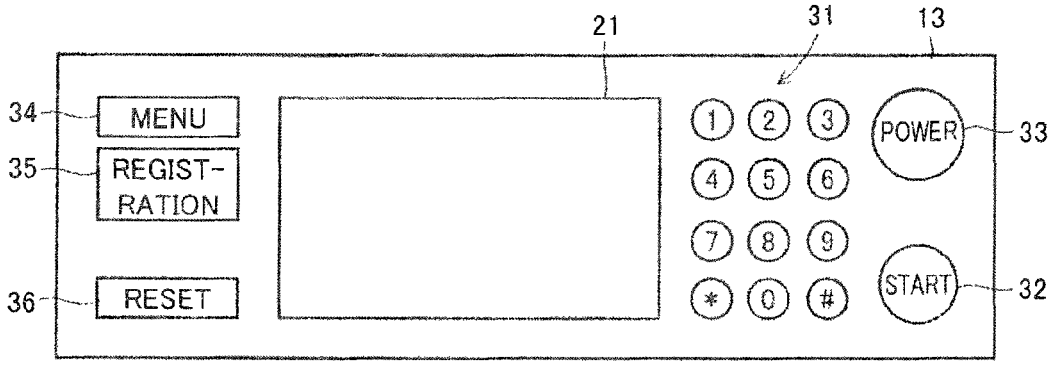
FIG. 3 is an outside view illustrating the schematic configuration of an operation unit.

Next, the configuration of the operation unit 13 described above is described in more detail. FIG. 3 is an outside view illustrating the schematic configuration of the operation unit 13. Referring to FIG. 3, the operation unit 13 includes a ten key 31 which inputs the numbers of 0 to 9 for inputting the number of prints and the like and inputs signs of "*" and "#", a start key 32 which instructs the start of printing and the start of facsimile transmission, a power supply key 33 which turns ON/OFF of the power supply of the digital multifunctional peripheral 11, a menu key 34 which instructs selection of a printer function, a copying function, and the like of the digital multifunctional peripheral 11, a registration key 35 which instructs registration of various image formation conditions and a user, a reset key 36 which resets the contents of the instructions input by a user using the ten key 31 and the like, and the display screen 21 described above. The display screen 21 has a liquid crystal touch-panel function and allows input of image formation conditions and the like also from the display screen 21 and also allows selection of the functions and the like by pressing with a user's finger or the like.

Figure 4:
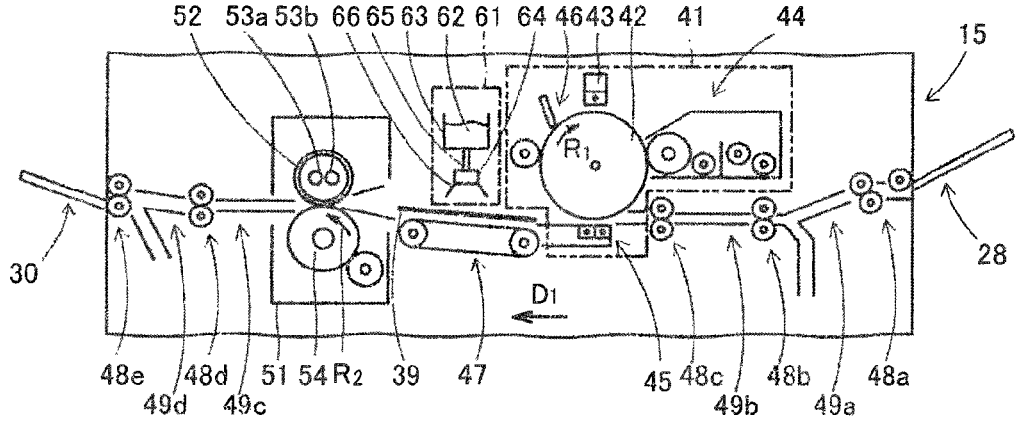
FIG. 4 is a view illustrating the schematic configuration of an image forming unit.

Next, the configuration of the image forming unit 15 is described in more detail. FIG. 4 is a view illustrating the schematic configuration of the image forming unit 15. Referring to FIG. 4, the image forming unit 15 has a developing unit 41 which forms a visible image on paper using a developing agent, such as toner. The developing unit 41 illustrated by chain double-dashed lines in FIG. 4 has a photoconductor 42 which forms an electrostatic latent image on the surface, a charging unit 43 which charges the surface of the photoconductor 42, a developing portion 44 which contains a developing sleeve and a plurality of stirring rollers and supplies a developing agent, such as toner, to the surface of the photoconductor 42 on which the electrostatic latent image is formed to form a visible image with the toner, a transferring unit 45 which contains a transfer charger and a separation charger and transfers the visible image formed on the surface of the photoconductor 42 to a conveyed paper 39, and a cleaning unit 46 which contains a static electricity eliminating roller, a cleaning blade, and the like and removes toner remaining on the surface of the photoconductor 42 after transferring the visible image to the paper 39, residual charges, and the like. The photoconductor 42 rotates in the direction indicated by an arrow $R_1$ in FIG. 4. The image forming unit 15 forms an electrostatic latent image on the photoconductor 42 based on an image read by the image reading unit 14. The image forming unit 15 supplies toner to the electrostatic latent image formed on the photoconductor 42 to form a visible image with the toner. The image forming unit 15 repeatedly subjects the photoconductor 42 to charging, developing, transferring, and cleaning to form a visible image on the conveyed paper 39 with toner. In order to compensate the toner consumed for the development, toner is further supplied to the developing portion 44 at all times by a toner container (not illustrated) detachably provided in the developing unit 41.

Figure 5:
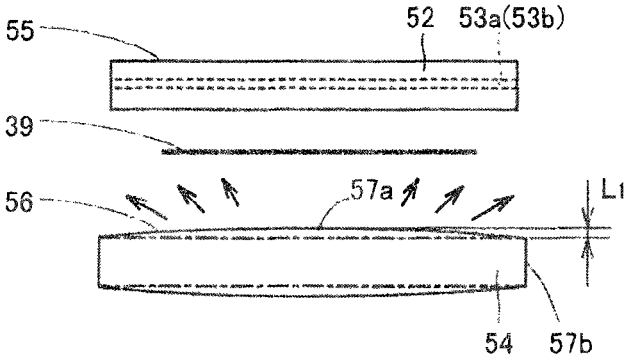
FIG. 5 is an exploded view illustrating the configuration of a fixing unit provided in the image forming unit.

The image forming unit 15 has a fixing unit 51 which fixes the visible image formed on the paper 39 by the developing unit 41 to the paper 39. FIG. 5 is an exploded view illustrating the structure of the fixing unit 51. Referring to FIG. 4 and FIG. 5, the fixing unit 51 contains a hollow rotatable heating roller 52 which heats paper when fixing toner to the paper and a solid rotatable pressurizing roller 54 which pressurizes paper when fixing toner to the paper. The heating roller 52 is configured from a cylindrical metal raw tube. The heating roller 52 is provided with a pair of heaters 53*a* and 53*b* therein. The heating roller 52 is heated to a predetermined temperature which is suitable for fixing by energizing the heaters 53*a* and 53*b*. The temperature of the heating roller 52 is controlled by controlling the energization state to the heaters 53*a* and 53*b*.

The pressurizing roller 54 is configured from a rubber cylindrical member having elasticity. The heating roller 52 and the pressurizing roller 54 abut on each other. Specifically, the heating roller 52 and the pressurizing roller 54 are provided in such a manner that the surface 55 of the heating roller 52 and the surface 56 of the pressurizing roller 54 contact each other. Since the heating roller 52 and the pressurizing roller 54 contact each other, a certain degree of the heat of the heating roller 52 is transmitted to the pressure roller 54. More specifically, the heating roller 52 and the pressurizing roller 54 are set to almost the same temperature.

The pressurizing roller 54 is configured in such a manner as to have a crowning shape. More specifically, a central portion 57*a* in the longitudinal direction of the pressurizing roller 54 is configured in such a manner as to swell to the outer diameter side with respect to an end portion 57*b* in the longitudinal direction of the pressurizing roller 54. A length $L_1$ in FIG. 5 shows a difference between the radius in the central portion 57*a* in the longitudinal direction of the pressurizing roller 54 and the radius in the end portion 57*b* in the longitudinal direction of the pressurizing roller 54. From the viewpoint of ease of understanding, the difference between the radii is illustrated with exaggeration in FIG. 5. The heating roller 52 and the pressurizing roller 54 are provided in such a manner as to abut on each other throughout the longitudinal direction. More specifically, since the pressurizing roller 54 has a crowning shape, the pressurizing roller 54 is configured to contact the heating roller 52 at higher pressure as approaching the central portion 57*a*.

The pressurizing roller 54 rotates in the direction indicated by an arrow $R_2$ in FIG. 4. The heating roller 52 rotates in a direction opposite to the rotation direction of the pressurizing roller 54. By the rotation of the heating roller 52 and the pressurizing roller 54, paper is conveyed from the upstream side to the downstream side. During the conveyance, the visible image formed on the paper is fixed by the heating roller 52 and the pressurizing roller 54. The direction where the paper 39 is conveyed is roughly illustrated by the arrow $D_1$ in FIG. 4. The conveyance direction of the paper 39 is the direction from the front surface to the back surface in FIG. 5. Herein, since the pressurizing roller 54 has the crowning shape configured in such a manner that the central portion 57*a* swells as described above, the paper 39 is conveyed in such a manner as to be pulled in the direction indicated by the arrows in FIG. 5, i.e., from the center toward the end portion of the paper 39. Thus, when passing the paper 39 through the fixing unit 51, wrinkles of the paper 39 can be smoothed-out and the generation of wrinkles of the paper 39 can be suppressed.

In the image forming unit 15, a conveying belt 47 provided between the developing unit 41 and the fixing unit 51 and a plurality of paper feeding rollers 48*a*, 48*b*, 48*c*, 48*d*, and 48*e* are provided. For example, the paper 39 set to the manual paper feed tray 28 is conveyed through paper conveying paths 49*a*, 49*b*, 49*c*, and 49*d* by the paper feeding rollers 48*a* to 48*e* to be discharged to the discharging tray 30. The paper 39 set in each of the paper feed cassettes 23*a* to 23*c* is conveyed through the paper conveying paths 49*b* to 49*d* by the paper feeding rollers 48*b* to 48*e* to be discharged to the discharging tray 30.

Herein, the image forming unit 15 contained in the digital multifunctional peripheral 11 has a spraying unit 61 as a liquid spraying unit which sprays liquid to the paper to be subjected to smoothing-out of wrinkles. The spraying unit 61 illustrated by the alternate long and short dash lines in FIG. 4 has a tank portion 63 which stores water 62 as liquid therein, a spraying section 64 which sprays the water 62 to be supplied from the tank portion 63 in the form of mist to the paper 39, a pipe portion 65 which supplies the water 62 to the spraying section 64 from the tank portion 63, and a guide unit 66 which guides the water 62 to be sprayed from the spraying section 64 not to spread to the developing unit 41 and the fixing unit 51 side. A spraying unit 61 is provided between the developing unit 41 and the fixing unit 51 in the conveyance direction D1 of the paper 39. The spraying unit 61 is provided above the conveying belt 47 and can spray the water 62 in the form of mist to the surface of the paper 39 to be conveyed on the conveying belt 47.

Figure 6:
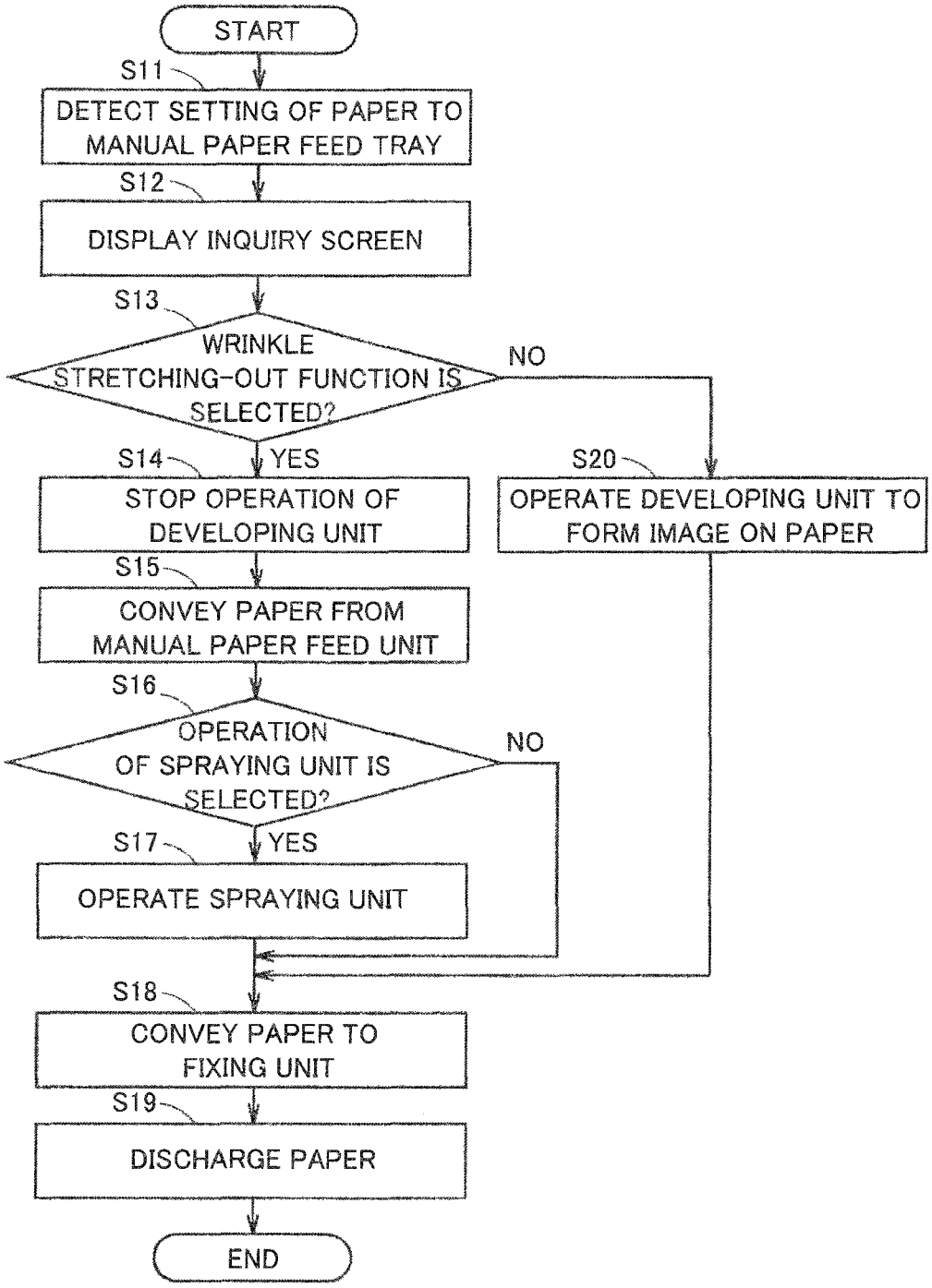
FIG. 6 is a flow chart showing the contents of processing when smoothing-out wrinkles of paper to be subjected to smoothing-out of wrinkles using the image forming apparatus according to one embodiment of the disclosure.

Next, a case where wrinkles of the paper to be subjected to smoothing-out of wrinkles are smoothed-out using the digital multifunctional peripheral 11 according to one embodiment of the disclosure is described. FIG. 6 is a flow chart showing the contents of processing when smoothing-out wrinkles of the paper to be subjected to smoothing-out of wrinkles. Referring to FIG. 6, etc., first, a user sets the paper to be subjected to smoothing-out of wrinkles to the manual paper feed tray 28. Then, the digital multifunctional peripheral 11 detects that the paper is set to the manual paper feed tray 28 (In FIG. 6, Step S11, "Step" is omitted below.). Next, the digital multifunctional peripheral 11 displays an inquiry screen which inquires whether or not the paper 39 set to the manual paper feed tray 28 is to be subjected to smoothing-out of wrinkles and whether or not the spraying unit 61 is to be operated on the display screen 21 of the operation unit 13 (S12).

Figure 7:
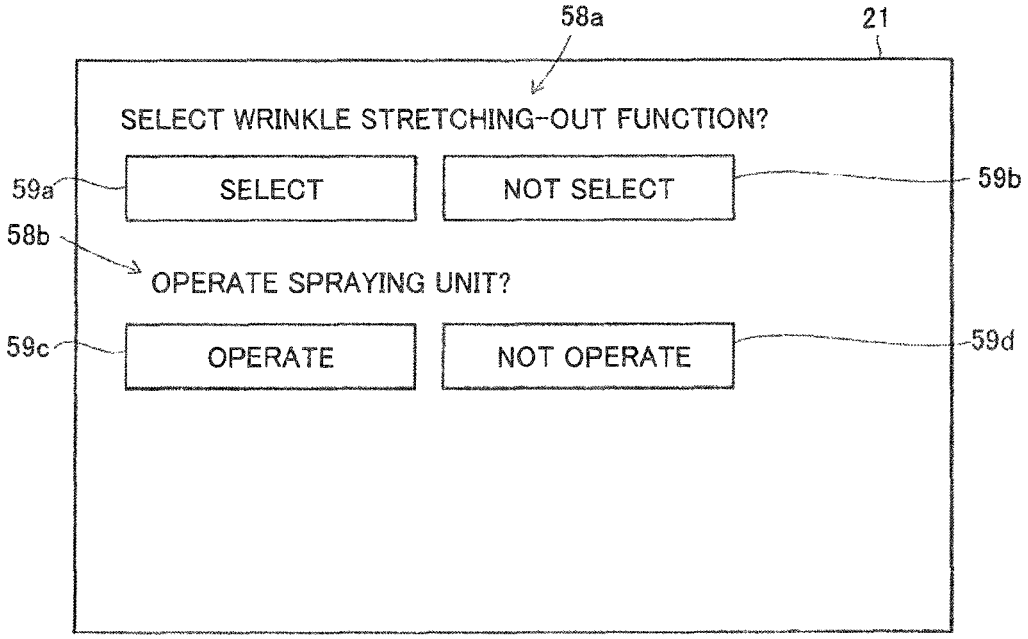
FIG. 7 is a view illustrating an example of a display screen contained in the operation unit.

FIG. 7 is a view illustrating an example of the display screen 21 of the operation unit 13 in this case. Referring to FIG. 7, the display screen 21 of the operation unit 13 displays an inquiry message 58*a* of "Select wrinkle stretching-out function?", a selection key 59*a* of "Select", and a selection key 59*b* of "Not select" and an inquiry message 58*b* of "Operate spraying unit?", a selection key 59*c* of "Operate", and a selection key 59*d* of "Not operate". By pressing each of the selection keys 59*a* to 59*d*, the selection of the functions can be achieved. Herein, the operation unit 13 operates as a receiving unit which receives a demand for smoothing-out of wrinkles of paper.

Herein, a user presses the selection key 59*a* of "Select" about the wrinkle smoothing-out function and presses the selection key 59*c* of "Operate" about the spraying unit 61. When the digital multifunctional peripheral 11 detects the pressing of the selection key 59*a* of "Select" (YES in S13), the digital multifunctional peripheral 11 stops the operation of the developing unit 41 (S14). Then, the plurality of paper feeding rollers 48*a* to 48*c* are rotated at an appropriate timing to convey the paper 39 to be subjected to smoothing-out of wrinkles from the manual paper feed tray 28 into the digital multifunctional peripheral 11, specifically, into the paper conveying paths 49*a* and 49*b* provided in the digital multifunctional peripheral 11 (S15).

Then, the operation of the spraying unit 61 is selected (YES in S16), and therefore the spraying unit 61 is operated at timing when the paper 39 to be subjected to smoothing-out of wrinkles is conveyed to the conveying belt 47 (S17). Specifically, the water 62 is sprayed in the form of mist to the paper 39 to be subjected to smoothing-out of wrinkles by the spraying section 64 provided in the spraying unit 61. In this case, the paper 39 may be stopped once on the conveying belt 47, and then the water 62 may be sprayed to the paper 39 or the conveyance rate of the paper 39 may be reduced instead of stopping the paper 39, and then the water 62 may be sprayed to the paper 39.

Thereafter, the paper 39 to be subjected to smoothing-out of wrinkles is conveyed to the fixing unit 51 (S18). Specifically, the paper is conveyed between the heating roller 52 heated to a predetermined temperature by the heaters 53*a* and 53*b* and the pressurizing roller 54. Then, wrinkles of the paper 39 to be subjected to smoothing-out of wrinkles are smoothed-out by the heating roller 52 and the pressurizing roller 54. Thereafter, the plurality of paper feeding rollers 48*d* and 48*e* are rotated at an appropriate timing to discharge the paper 39 to be subjected to smoothing-out of wrinkles through the paper conveying paths 49*c* and 49*d* to the outside 30 of the apparatus, i.e., the discharging tray (S19).

On the other hand, when the wrinkle smoothing-out function is not selected (NO in S13), it is judged that image formation on paper set to the usual manual paper feed tray 28 is selected, and then the developing unit 41 is operated to form an image on the paper (S20). Thereafter, the paper on which the image is formed is discharged to the fixing unit 51 (S18), the image is fixed to the paper 39, and then the paper is discharged (S19). When the selection key 59*d* of "Not operate" is pressed and the operation of the spraying unit 61 is not selected (NO in S16), the paper 39 to be subjected to smoothing-out of wrinkles is conveyed to the fixing unit 51 without operating the spraying unit 61 (S18). Thereafter, wrinkles of the paper 39 to be subjected to smoothing-out of wrinkles are smoothed-out by the fixing unit 51, and then the paper 39 is discharged (S19).

When the digital multifunctional peripheral 11 of such a configuration receives the demand for smoothing-out of wrinkles of the paper 39, the digital multifunctional peripheral 11 does not operate the developing unit 41 and conveys the paper 39 to be subjected to smoothing-out of wrinkles set to the manual paper feed tray 28 to the fixing unit 51. Then, when the paper 39 to be subjected to smoothing-out of wrinkles is conveyed between the heating roller 52 and the pressurizing roller 54, the wrinkles of the paper 39 are smoothed-out by the heating roller 52 and the pressurizing roller 54. In this case, since the developing unit 41 is not operated, an image is not formed on the paper 39. Therefore, the digital multifunctional peripheral 11 of such a configuration can efficiently reduce the wrinkles of the paper 39.

In this case, since the spraying unit 61 as a liquid spraying unit which sprays the water 62 to the paper 39 to be subjected to smoothing-out of wrinkles is provided, the water 62 is sprayed to the paper 39 to be subjected to smoothing-out of wrinkles when smoothing-out the wrinkles of the paper 39, and then the wrinkles of the paper 39 can be efficiently reduced.

Moreover, in this case, since the spraying unit 61 is provided between the developing unit 41 and the fixing unit 51 in the paper conveying paths 49*a* to 49*d* of the paper 39 to be subjected to smoothing-out of wrinkles, the water 62 can be sprayed to the paper 39 to be subjected to smoothing-out of wrinkles at more appropriate timing.

Moreover, the digital multifunctional peripheral 11 is configured to inquire whether or not the spraying unit 61 is to be operated in this case. Therefore, by detecting the pressing of the selection key 59*d* of "Not operate" when a user does not want the spraying of the water 62 or the like in the case of smoothing-out wrinkles of paper containing an image formed with an aqueous ink and the like, for example, the water 62 is not sprayed.

In the embodiment described above, the digital multifunctional peripheral 11 is configured to inquire a user about whether nor not the spraying unit 61 is operated but the configuration is not limited thereto and the digital multifunctional peripheral 11 may be configured so that when the control unit 12 receives a demand for smoothing-out of wrinkles, liquid may be sprayed to the paper 39 to be subjected to smoothing-out of wrinkles. Thus, the liquid can be sprayed to the paper 39 without separately setting the spraying unit 61 to spray the liquid to the paper 39, so that the wrinkles of the paper 39 can be more efficiently reduced.

Figure 8:
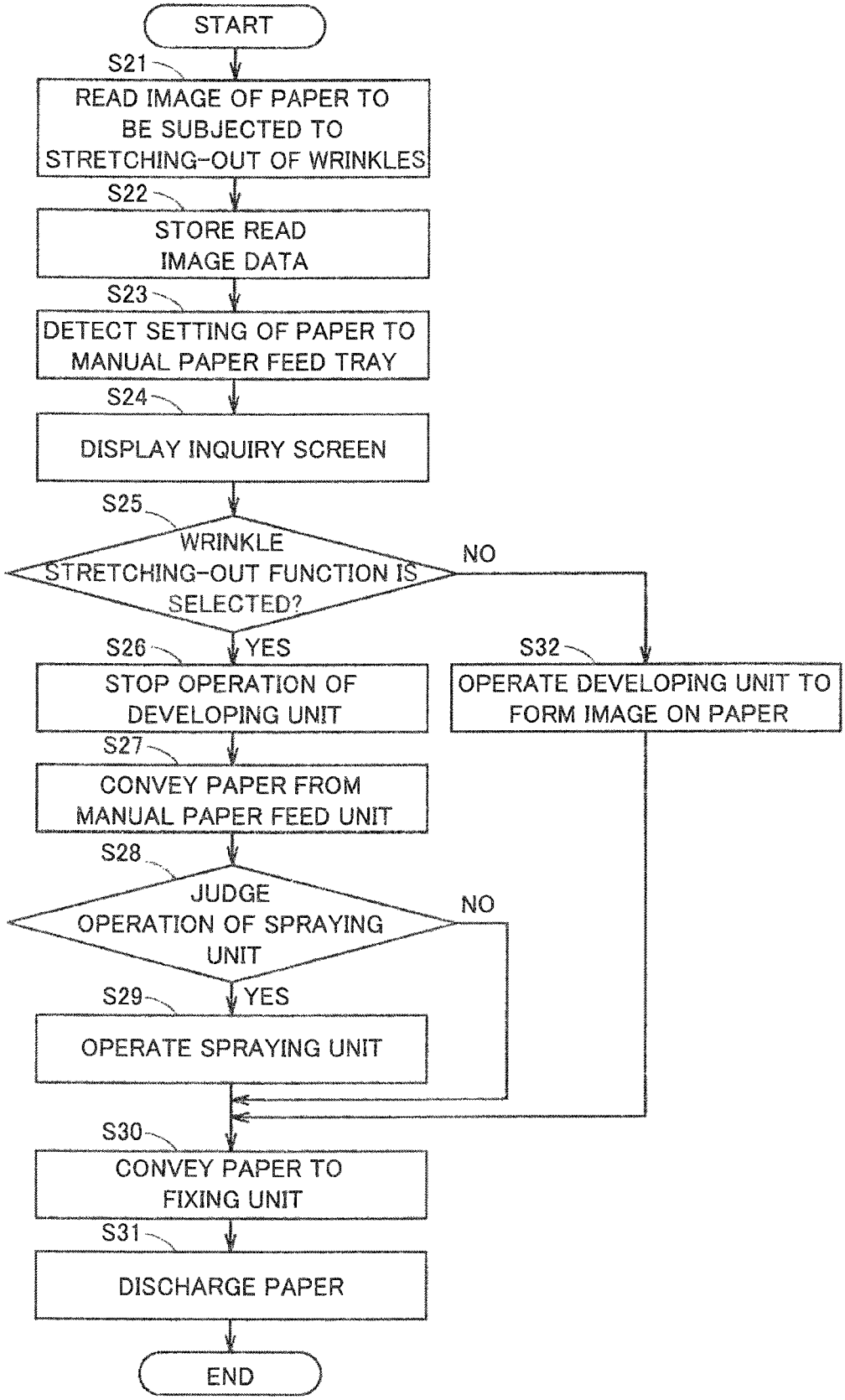
FIG. 8 is a flow chart showing the contents of processing when smoothing-out wrinkles of paper to be subjected to smoothing-out of wrinkles using an image forming apparatus according to another embodiment of the disclosure.

In the embodiment described above, the digital multifunctional peripheral 11 may be configured so that the image of the paper 39 to be subjected to smoothing-out of wrinkles is read by the image reading unit 14, and then the read image result may be utilized for smoothing-out wrinkles. FIG. 8 is a flow chart showing the flow of the processing in this case. Referring to FIG. 8, etc., the image of the paper 39 to be subjected to smoothing-out of wrinkles is first read (S21). In this case, the image of the paper 39 may be automatically read using the ADF22 described above or the paper 39 to be subjected to smoothing-out of wrinkles may be placed on a placement table provided in the image reading unit 14, and then the image of the paper 39 may be read by scanning. The read image data are stored in the hard disk 16 (S22).

Thereafter, when the paper 39 to be subjected to smoothing-out of wrinkles set to the manual paper feed tray 28 is detected (S23), an inquiry screen is displayed in the same manner as in the case shown in FIG. 6 (S24).

Figure 9:
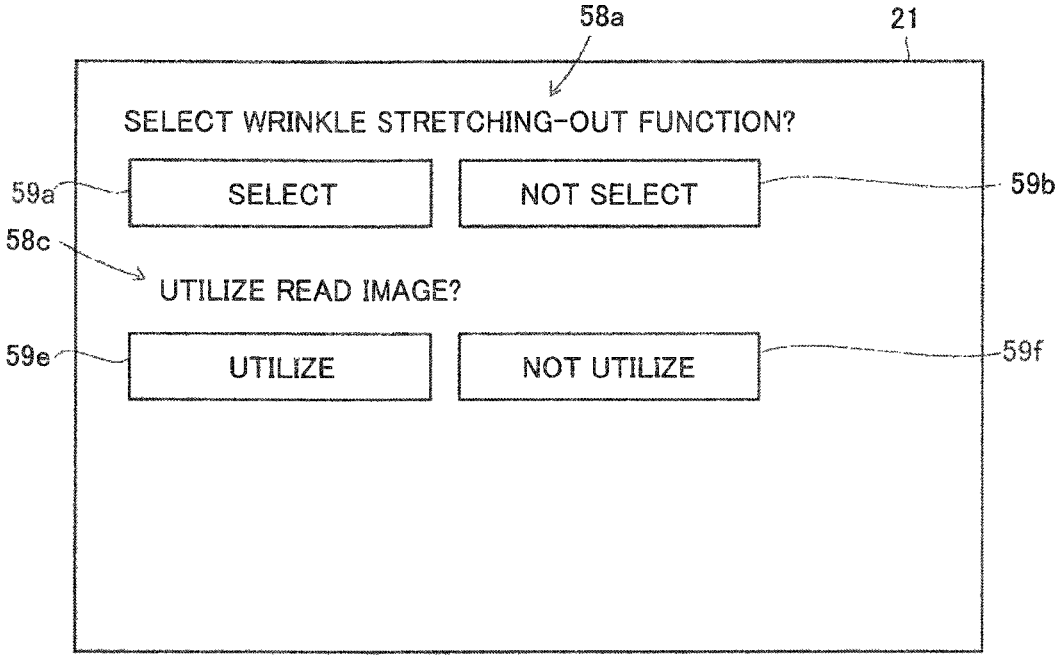
FIG. 9 is a view illustrating an example of the display screen contained in the operation unit.

FIG. 9 is a view illustrating an example of the display screen of the operation unit 13 in this case. Referring to FIG. 9, on the display screen 21 of the operation unit 13, the inquiry message 58*a* of "Select wrinkle smoothing-out function", the selection key 59*a* of "Select", and the selection key 59*b* of "Not select" and an inquiry message 58*c* of "Utilize read image", a selection key 59*e* of "Utilize", and a selection key 59*f* of "Not utilize" are displayed. By the pressing of each of the selection keys 59*a* to 59*f*, the selection of the functions can be achieved.

Herein, a user presses the selection key 59*a* of "Select" about the wrinkle smoothing-out function and presses the selection key 59*e* of "Utilize" about the read image. When the digital multifunctional peripheral 11 detects the pressing of the selection key 59*a* of "Select" (YES in S25), the digital multifunctional peripheral 11 stops the operation of the developing unit 41(S26). Then, the paper 39 to be subjected to smoothing-out of wrinkles is conveyed into the digital multifunctional peripheral 11 from the manual paper feed tray 28 (S27).

Next, since the control unit 12 detects that the selection key 59*e* of "Utilize" is pressed about the read image on the inquiry screen, the control unit 12 judges whether or not the spraying unit 61 is to be operated from the read image (S28). More specifically, for example, the control unit 12 recognizes a black shadow portion formed under the influence of wrinkles from the read image stored in the hard disk 16 about the paper 39 to be subjected to smoothing-out of wrinkles. Then, the control unit 12 judges whether or not the spraying unit 61 is to be operated based on whether or not the shade degree of the black shadow portion exceeds the predetermined threshold value.

When the control unit 12 judges that the spraying unit is operated (YES in S28), the spraying unit 61 is operated (S29). More specifically, the water 62 is sprayed from the spraying section 64 in the form of mist to the paper 39 to be subjected to smoothing-out of wrinkles.

Thereafter, the paper 39 is conveyed to the fixing unit 51 (S30), wrinkles are smoothed-out, and then the paper is discharged (S31) in the same manner as in the case shown in FIG. 6. On the other hand, when the control unit 12 judges that the spraying unit 61 is not operated in S28 (NO in S28), the paper 39 is conveyed to the fixing unit 51 without operating the spraying unit 61 (S30), wrinkles are smoothed-out, and then the paper is discharged (S31). When the wrinkle smoothing-out function is not selected (NO in S25), the developing unit is operated to form an image on paper (S32), the paper 39 is conveyed to the fixing unit 51 for fixing (S30), and then the paper is discharged (S31).

According to such a configuration, since the image reading unit 14 which reads the image of the paper to be subjected to smoothing-out of wrinkles is provided, the position, size, and range where wrinkles are present in the paper 39 to be subjected to smoothing-out of wrinkles can be grasped before smoothing-out wrinkles by the fixing unit 51, and thus smoothing-out of wrinkles more corresponding to the state of the wrinkles can be achieved, so that the wrinkles of the paper 39 can be more efficiently reduced.

In this case, since the control unit 12 judges whether or not the water 62 is to be sprayed to the paper to be subjected to smoothing-out of wrinkles by the spraying unit 61 as a liquid spraying unit from the image read by the image reading unit, more appropriate smoothing-out of wrinkles according to the state of the wrinkles can be achieved.

In the embodiment described above, when the receiving unit receives a demand for smoothing-out of wrinkles, the control unit may perform control to change at least one of the number of rotations of the heating roller, the number of rotations of the pressurizing roller, the temperature of the heating roller, the temperature of the pressurizing roller, and the conveyance rate of the paper to be subjected to smoothing-out of wrinkles. Thus, the wrinkles of the paper 39 can be more efficiently reduced according to the material of the paper 39 or the wrinkle state.

In the embodiment described above, the spraying unit is configured to spray water in the form of mist. However, the configuration is not limited thereto and the spraying unit may be configured to spray another kind of liquid other than water. Moreover, the spraying unit may be configured to spray liquid to paper with a certain degree of force without being limited to the configuration of spraying liquid in the form of mist.

In the embodiment described above, the spraying unit is provided between the developing unit and the fixing unit in the paper conveyance direction. However, the configuration is not limited thereto and the spraying unit may be provided before the developing unit, for example, without being limited to the configuration. It is a matter of course that a plurality of spraying units may be provided.

In the embodiment, paper set to the manual paper feed tray is subjected to smoothing-out of wrinkles. However, the configuration is not limited thereto and a configuration may be acceptable in which paper set to the paper feed cassette provided in the paper feed cassette group is subjected to smoothing-out of wrinkles.

The following configuration may also be acceptable. More specifically, the control unit 12 which is included in the digital multifunctional peripheral 11 has a folding frequency detecting unit 67 which detects the frequency in which paper is folded from an image read by the image reading unit 14. Then, the control unit may be configured to perform control to change the temperatures of the heating roller and the pressurizing roller according to the folding frequency of paper detected by the folding frequency detecting unit. Thus, wrinkles of folded paper can be appropriately smoothed-out. In this case, specifically, when the image reading unit reads that paper has one wrinkle, the frequency in which the paper is folded is detected to be 1 time. Then, the temperatures of the heating roller and the pressurizing roller are slightly increased, and then the wrinkle of the paper is smoothed-out. When the image reading unit reads that paper has three wrinkles or when the image reading unit reads that wrinkles of paper are formed in the shape of a cross, the frequency in which the paper is folded is detected to be 2 times. Then, the temperatures of the heating roller and the pressurizing roller are increased to a temperature higher than the temperature when the folding frequency is 1 time described above, and then the wrinkles of the paper are smoothed-out. Such a configuration may be acceptable.

The embodiments and Examples disclosed in this specification are examples in all the respects and are not limited in any aspect. The scope of the disclosure is defined by not the description above but the claims and any alternation which comes within the meaning of the scope of the claims is to be embraced within the scope of the claims.

The image forming apparatus according to the disclosure is particularly effectively utilized when efficient smoothing-out of wrinkles is required.

What is claimed is:

1. An image forming apparatus, comprising:

a developing unit which forms a visible image on paper using a developing agent;

a fixing unit which includes a heating roller and a pressurizing roller abutting on the heating roller and which conveys the paper on which the visible image is formed by the developing unit between the heating roller and the pressurizing roller to fix the visible image to the paper;

an operation unit which receives a demand for smoothing-out of wrinkles of the paper;

a paper setting unit which sets the paper to be subjected to smoothing-out of wrinkles;

a control unit which performs control so that the developing unit is not operated and the paper to be subjected to smoothing-out of wrinkles set in the paper setting unit is conveyed to the fixing unit when the operation unit receives the demand for smoothing-out of wrinkles; and a liquid spraying unit which sprays a liquid to the paper to be subjected to smoothing-out of wrinkles, wherein the liquid spraying unit is provided between the developing unit and the fixing unit in a conveyance path of the paper to be subjected to smoothing-out of wrinkles, wherein, when the operation unit receives the demand for smoothing-out of wrinkles, the control unit controls the spraying unit to spray the liquid to the paper to be subjected to smoothing-out of wrinkles.

2. The image forming apparatus according to claim 1, wherein, when the operation unit receives the demand for smoothing-out of wrinkles, the control unit changes any one of a number of rotations of the heating roller, a number of rotations of the pressure roller, a temperature of the heating roller, a temperature of the pressure roller, and a conveyance rate of the paper to be subjected to smoothing-out of wrinkles corresponding to a setting when fixing the visible image to paper.

3. An image forming apparatus, comprising:

a developing unit which forms a visible image on paper using a developing agent;

a fixing unit which includes a heating roller and a pressurizing roller abutting on the heating roller and which conveys the paper on which the visible image is formed by the developing unit between the heating roller and the pressurizing roller to fix the visible image to the paper;

an operation unit which receives a demand for smoothing-out of wrinkles of the paper;

a paper setting unit which sets the paper to be subjected to smoothing-out of wrinkles;

a control unit which performs control so that the developing unit is not operated and the paper to be subjected to smoothing-out of wrinkles set in the paper setting unit is conveyed to the fixing unit when the operation unit receives the demand for smoothing-out of wrinkles;

a liquid spraying unit which sprays a liquid to the paper to be subjected to smoothing-out of wrinkles; and an image reading unit which reads an image of the paper to be subjected to smoothing-out of wrinkles;

wherein the liquid spraying unit is provided between the developing unit and the fixing unit in a conveyance path of the paper to be subjected to smoothing-out of wrinkles, wherein the control unit judges from an image read by the image reading unit whether or not the liquid is to be sprayed to the paper to be subjected to smoothing-out of wrinkles by the liquid spraying unit.

4. An image forming apparatus, comprising:

a developing unit which forms a visible image on paper using a developing agent;

a fixing unit which includes a heating roller and a pressurizing roller abutting on the heating roller and which conveys the paper on which the visible image is formed by the developing unit between the heating roller and the pressurizing roller to fix the visible image to the paper;

an operation unit which receives a demand for smoothing-out of wrinkles of the paper;

a paper setting unit which sets the paper to be subjected to smoothing-out of wrinkles;

a control unit which performs control so that the developing unit is not operated and the paper to be subjected to smoothing-out of wrinkles set in the paper setting unit is conveyed to the fixing unit when the operation unit receives the demand for smoothing-out of wrinkles;

a liquid spraying unit which sprays a liquid to the paper to be subjected to smoothing-out of wrinkles; wherein the liquid spraying unit is provided between the developing unit and the fixing unit in a conveyance path of the paper to be subjected to smoothing-out of wrinkles, an image reading unit which reads an image of the paper to be subjected to smoothing-out of wrinkles; and the control unit includes a folding frequency detecting unit which detects a frequency in which the paper is folded from an image read by the image reading unit, wherein the control unit performs control to change temperatures of the heating roller and the pressure roller according to the folding frequency of the paper detected by the folding frequency detecting unit.

* * * * *